US006749409B2

(12) United States Patent
Fukamachi et al.

(10) Patent No.: US 6,749,409 B2
(45) Date of Patent: Jun. 15, 2004

(54) MAGNETIC FORCE TYPE PUMP DRIVING APPARATUS IN VEHICULAR ENGINE

(75) Inventors: Masatoshi Fukamachi, Saitama (JP); Yoshiyuki Sekiya, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 89 days.

(21) Appl. No.: 10/023,718

(22) Filed: Dec. 21, 2001

(65) Prior Publication Data

US 2002/0085933 A1 Jul. 4, 2002

(30) Foreign Application Priority Data

Dec. 22, 2000 (JP) ..... 2000-391442

(51) Int. Cl.[7] ..... F04B 17/00
(52) U.S. Cl. ..... 417/420; 417/423.1; 123/41.44
(58) Field of Search ..... 417/420, 423.1, 417/423.15; 123/41.44, 41.47

(56) References Cited

U.S. PATENT DOCUMENTS 4,013,384 A * 3/1977 Oikawa ..... 417/420
4,662,320 A * 5/1987 Moriya ..... 123/41.44
4,722,661 A * 2/1988 Mizuno ..... 417/420
5,779,456 A * 7/1998 Bowes et al. ..... 417/420
6,481,391 B2 * 11/2002 Nabeya et al. ..... 123/41.44
6,607,370 B2 * 8/2003 Fukamachi et al. ..... 417/420

FOREIGN PATENT DOCUMENTS

JP 10-89069 4/1998
WO WO 99/10655 A1 3/1999

* cited by examiner

*Primary Examiner*—Cheryl J. Tyler
(74) *Attorney, Agent, or Firm*—Birch, Stewart, Kolasch & Birch, LLP

(57) ABSTRACT

In a magnet force type pump driving apparatus in a vehicular engine, a large diameter formation of driving and driven magnets is enabled without being interfered with by a driven rotating member of a wrapping transmission apparatus, thereby achieving an increase in transmission torque. A magnet holder crossing a rotational center face P of a wrapping member of a wrapping transmission apparatus is fixedly attached to a driven rotating member. A driving magnet is arranged at an outer side of the driven rotating member and is attached to the magnet holder. A driven magnet is axially supported by a pump housing arranged to cross the rotational center face P on an inner peripheral side of the driving magnet.

17 Claims, 4 Drawing Sheets

MAGNETIC FORCE TYPE PUMP DRIVING APPARATUS IN VEHICULAR ENGINE

CROSS-REFERENCE TO RELATED APPLICATIONS

The present application claims priority under 35 USC 119 to Japanese Patent Application No. 2000-391442 filed on Dec. 22, 2000 the entire contents thereof is hereby incorporated by reference.

BACKGROUND OF THE INVENTION

1. Field of the Invention

The present invention relates to a magnetic force type pump driving apparatus for a vehicular engine. More particularly, to an improvement wherein a driving magnet in a ring-like shape is fixedly attached to a driven rotating member which is fixedly attached to one end of a driven shaft of a wrapping transmission apparatus connecting a crank shaft and a driven shaft, a driven magnet concentrically arranged to an inner peripheral side of the driving magnet such that torque can be transmitted to each other, is axially supported rotatably by a pump housing arranged between the two magnets and a pump rotating member is connected to the driven magnet.

2. Description of Background Art

A magnetic type pump driving apparatus is disclosed in, for example, Japanese Patent Laid-Open No. 89069/1998.

The magnetic force type pump driving apparatus as set forth in Japanese Patent Laid-Open No. 89069/1998 discloses a transmission torque between the driving and the driven magnets that is significantly dependent on the diameters of the magnets. However, according to the conventional apparatus, as set forth in Japanese Patent Laid-Open No. 89069/1998, the driving magnet is fixedly attached to an inner peripheral face of a hub having a cylindrical shape of the driven rotating member and accordingly, a large diameter formation of the driving and the driven magnets is restricted by the driven rotating member and it is difficult to achieve an increase in the transmission torque therebetween by the large diameter formation of the driving and the driven magnets.

SUMMARY AND OBJECTS OF THE INVENTION

The invention has been carried out in view of the driving and driven magnets. It is an object thereof to provide a magnetic force type pump driving apparatus in a vehicular engine enabling a large diameter formation of a driving and a driven magnet without being interfered with by the driven rotating member of the wrapping transmission apparatus, capable of achieving an increase in transmission torque and capable of being constituted comparatively compactly.

In order to achieve the above-described object, the invention includes a magnetic force type pump driving apparatus in a vehicular engine in which a driving magnet in a ring-like shape is fixedly attached to a driven rotating member fixedly attached to one end of a driven shaft of a wrapping transmission apparatus for connecting a crank shaft and the driven shaft. A driven magnet is arranged to an inner peripheral side of the driving magnet concentrically to be able to transmit a torque mutually and is axially supported rotatably by a pump housing arranged between the two magnets and a pump rotating member is connected to the driven magnet. A magnet holder crosses a rotational center face of a wrapping member of the wrapping transmission apparatus and is fixedly attached to the driven rotating member. The driving magnet arranged at an outer side of the driven rotating member, is attached to the magnet holder and the driven magnet is axially supported by the pump housing arranged to cross the rotational center face on an inner peripheral side of the driving magnet.

Further, the driven shaft, the wrapping transmission apparatus, the driven rotating member, the wrapping member and the pump rotating member, correspond respectively to a cam shaft 34, a timing controlling transmission apparatus 35, a driven sprocket 37, a timing chain 38 and a pump impeller 48 in an embodiment of the invention, described later.

According to the present invention, the driving magnet arranged at the outer side of the driven rotating member is attached to the magnet holder and therefore, a large diameter formation of the driving and the driven magnets is enabled without being interfered with by the driven rotating member of the wrapping transmission apparatus and an increase in transmission torque of the magnets can be achieved. Further, the magnet holder supporting the driving magnet and the pump housing supporting the driven magnet are arranged such that the magnets cross the rotational center face of the wrapping member and therefore, a space on an inner peripheral side of the driven rotating member, constitutes a space for containing portions of the magnet holder and the pump housing and a total of the pump driving apparatus can be restrained from being enlarged in the axial direction.

Further, the present invention is directed to a driven rotating member that is fixedly attached to an end face of the driven shaft by a plurality of bolts arranged around an axis line of the driven shaft and a boss projecting from an outer side face of the pump housing for axially supporting the driven magnet is made to face a space surrounded by head portions of the bolts.

According to the present invention, the pump housing can be arranged to be as proximate as possible to the driven shaft while avoiding mutual interference between the bolts and the boss and accordingly, space efficiency on the inner peripheral side of the driven rotating member is promoted, which can contribute to compact formation of the pump driving apparatus.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

An explanation will be given of a mode for carrying out the invention based on an embodiment of the invention shown in the attached drawings.

Figure 1:
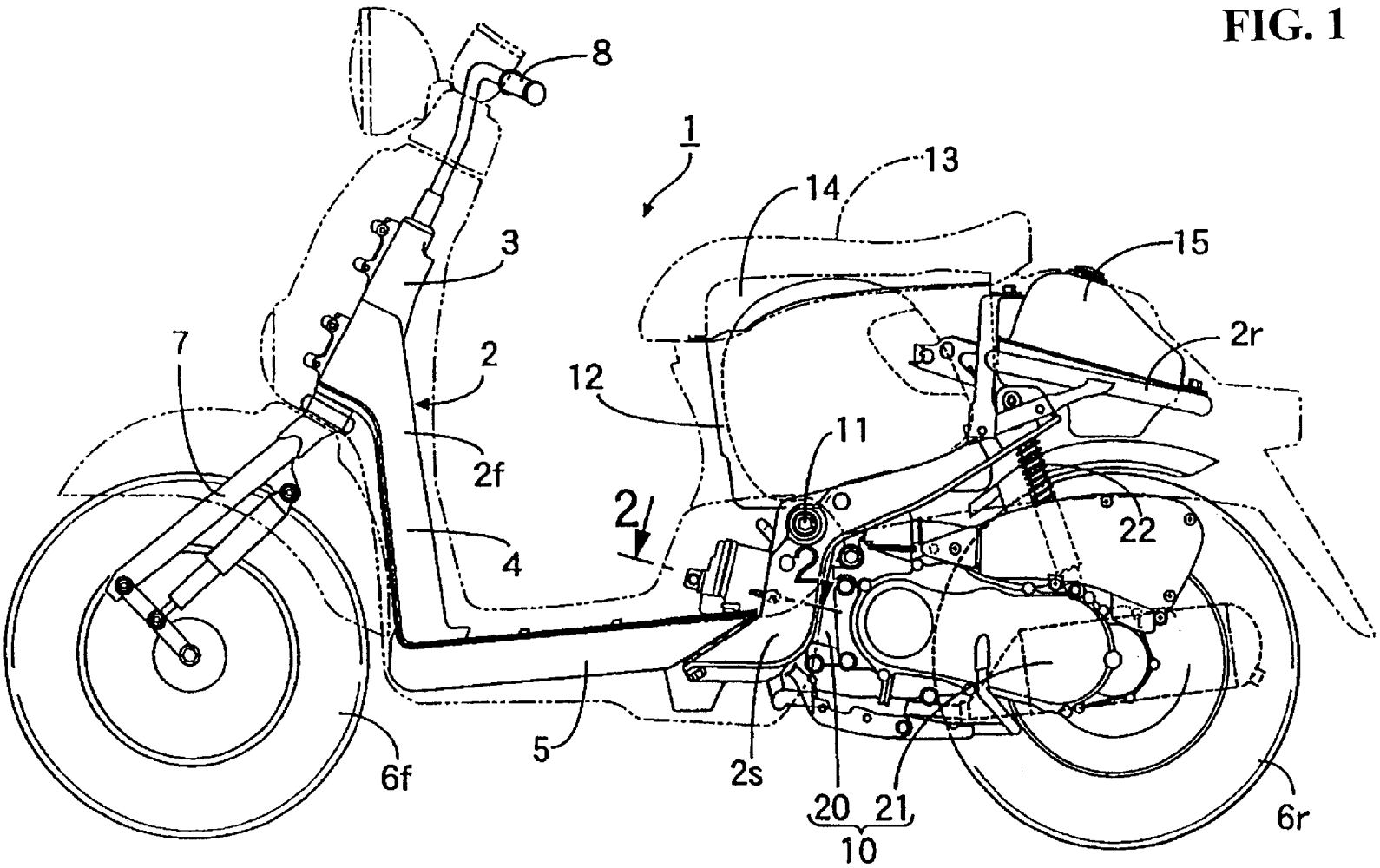
FIG. 1 is a side view of a total of a scooter type motorcycle having a magnetic force type pump driving apparatus according to the present invention.

FIG. 1 illustrates a vehicle body frame 2 of a scooter type motorcycle 1 that is divided into three sections, a front frame 2*f*, a center frame 2*s* and a rear frame 2*r*. The front frame 2*f* includes a cast product of an aluminum alloy integrally provided with a head pipe 3, a down tube 4 and a step floor 5. A front fork 7 for supporting a front wheel 6*f* is steerably supported by the head pipe 3 and a steering handlebar 8 is attached to an upper end thereof.

The center frame 2*s* is a cast product of an aluminum alloy and is coupled to a rear end portion of the step floor 5 by bolts. A power unit 10 for supporting a rear wheel 6*r* at its rear end portion, is connected to the center frame 2*s* pivotably in the up and down direction via a pivot shaft 11. A helmet case 12 is supported by an upper face of the center frame 2*s*. A lid 14 is integrated to a seat 13 for opening and closing and upper opening portion thereof. The lid 14 is coupled to a front end portion of the case 12 by a hinge.

The rear frame 2*r* includes a pipe member and is coupled to a rear end portion of the center frame 2*s* by bolts on an upper side of the power unit 10. A fuel tank 15 is attached to surround the rear frame 2*r*.

The power unit 10 includes a water cooling type single-cylinder four-cycle engine 20 and a continuously variable transmission 21 of a belt type extending from one side portion of the engine 20 to a rear side of the vehicle body for driving the rear wheel 6*r*. The continuously variable transmission 21 is supported by the center frame 2*s* via a rear cushion 22.

Figure 2:
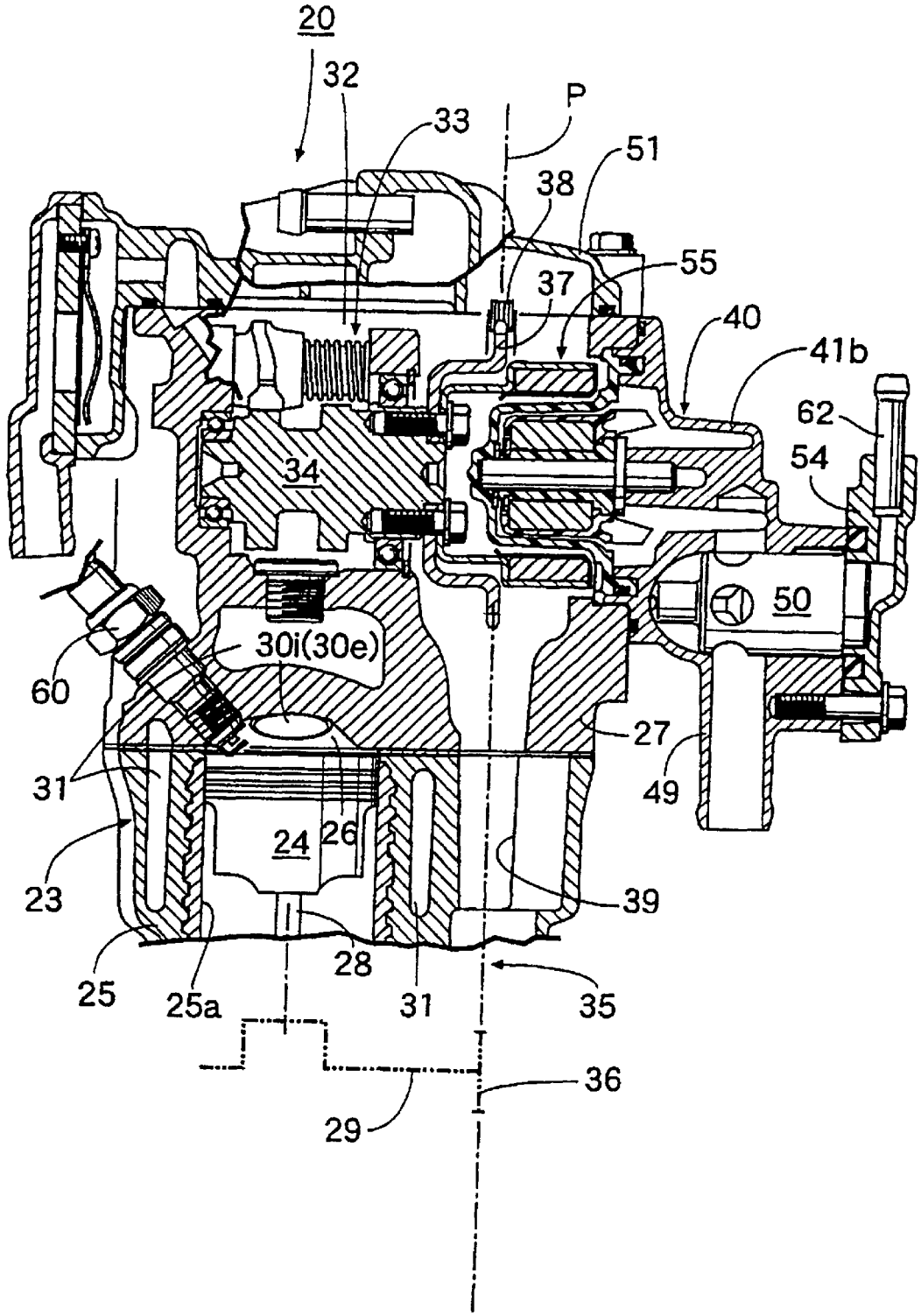
FIG. 2 is a vertical plane sectional view of essential portions of an engine in the above-described motorcycle.
Figure 3:
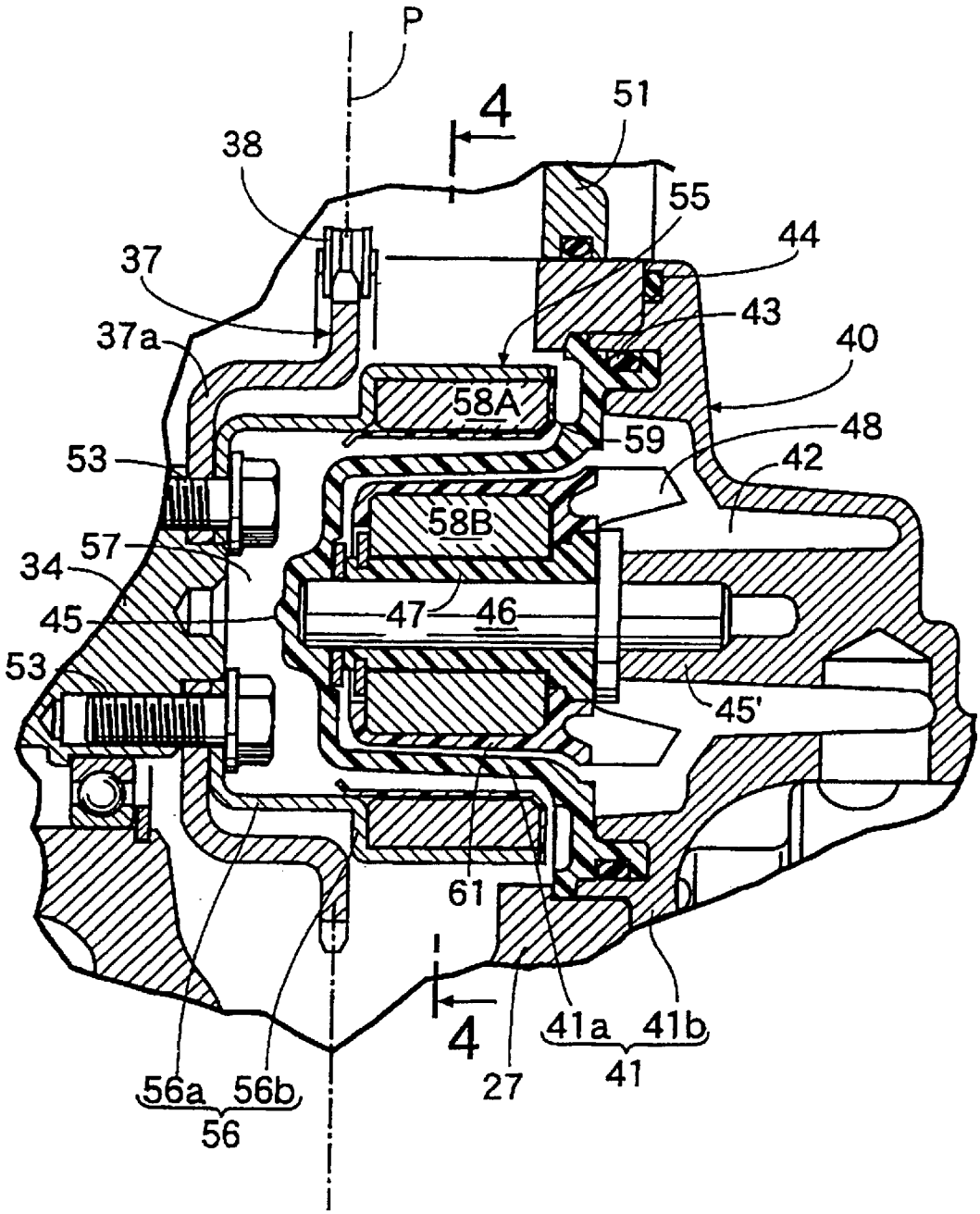
FIG. 3 is an enlarged view of essential portions of FIG. 2.

As shown by FIG. 2 and FIG. 3, an engine main body 23 of the engine 20 is provided with a cylinder block 25 having a cylinder bore 25*a* to which a piston 24 is slidably fitted. A cylinder head 27 is coupled to an end face of the cylinder block 25 for partitioning a combustion chamber 26 between a top face of the piston 24 and the cylinder head 27. A crank case (not illustrated) is provided for rotatably supporting a crank shaft 29 connected to the piston 24 via a connecting rod 28. The cylinder head 27 includes an ignition plug 60 with an electrode that is screwed into the cylinder head 27 and faces the combustion chamber 26. Further, the cylinder block 25 and cylinder head 27 are formed with water jackets 31 for providing cooling water.

A valve operating chamber 32 is partitioned between the cylinder head 27 and a head cover 51 coupled to the cylinder head 27. In the valve operating chamber 32, there is arranged a valve operating mechanism 33 for driving to open and close intake and exhaust valves 30*i* and 30*e* attached to the head cover 27. A cam shaft 34 includes a portion of the mechanism 33 that is rotatably supported by the cylinder head 27 in parallel with the crank shaft 29. The cam shaft 34 is connected to the crank shaft 29 via a timing controlling transmission apparatus 35.

The timing controlling transmission apparatus 35 is constituted by a driving sprocket 36 fixedly attached to one end portion of the crank shaft 29. A driven sprocket 37 is fixedly attached to one end portion of the cam shaft 34. An endless timing chain 38 is made to wrap on the two sprockets 36 and 37 for transmitting rotation of the crank shaft 29 to the cam shaft 34 by reducing speed by a speed reducing ratio of one half. The timing controlling transmission apparatus 35 is arranged in a timing controlling chamber 39 formed at a side wall of the cylinder block 25 and continuous to the valve operating chamber 32.

On one side of the cylinder head 27, there is provided a water pump 40 for circulating cooling water in a cooling water circuit including the water jackets 31. The water pump 40 is provided with a pump housing 41 including an inner side housing half 41*a* projecting to a side of the valve operating chamber 32 and an outer side housing half 41*b* coupled to one side of the cylinder head 27 along with the inner side housing half 41*a*. A pump chamber 42 is formed in the outer side housing half 41*b*. The seal member 43 is interposed at a bond portion of the two housing halves 41*a* and 41*b*, and a seal member 44 is interposed also at a bond portion of the outer side housing half 41*b* and the cylinder head 27 to thereby make the pump chamber 42 watertight.

Bosses 45 and 45' that are coaxially aligned with the cam shaft 34 are formed at walls of the two housing halves 41*a* and 41*b* opposed to each other. A pump shaft 47 in a cylindrical shape is rotatably supported by a support shaft 46 both ends of which are supported by the bosses 45 and 45'. A pump impeller 48 is contained in the pump chamber 42 and is fixedly provided to the pump shaft 47. The outer side housing half 41*b* is formed with a delivery pipe 49 communicating with an outer peripheral portion of the pump chamber 42 and provided with a thermostat 50 for opening and closing the delivery pipe 49. When the thermostat 50 is opened, cooling water sucked from a radiator, not illustrated, to a central portion of the pump chamber 42, is pressurized by rotation of the pump impeller 48, supplied to the water jackets 31 via the delivery pipe 49 and cools the engine main body 23. Cooling water which has finished cooling is recirculated to the radiator.

A side cover 54 is bonded to an outer side face of the outer side housing half 41*b* and is provided with an inlet pipe 62 of a bypass water pass for returning cooling water delivered from the pump chamber 42 directly to the water jackets 31 without detouring to the radiator, not illustrated, when the thermostat 50 is closed.

A magnetic force type pump driving apparatus 55 according to the present invention is provided for driving the water pump 40 between the driven sprocket 37 and the water pump 40. An explanation will be given of the construction as follows.

The driven sprocket 37 is integrally provided with a hub 37*a* in a shape of a bottomed cylinder bulged to a side of the cam shaft 34 at its central portion and a bottom portion of the hub 37*a* is fixedly attached to one end face of the cam shaft 34 by a plurality of pieces of bolts 53 along with a magnet holder 56 coaxially laminated therewith. At this occasion, the plurality of pieces of bolts 53 are arranged around an axis line of the cam shaft 34.

The magnet holder 56 includes a nonmagnetic stainless steel plate that is pressed and is formed in a shape of a bottomed and stepped cylinder. That is, the magnet holder 56 is formed by integrally connecting a large diameter cylindrical portion 56*b* having a diameter larger than an inner diameter of the hub 37*a* to an opening end of a small diameter cylindrical portion 56*a* which is bottomed and is provided with a diameter smaller than the inner diameter of the hub 37*a* via a ring-like stepped portion. The small diameter cylindrical portion 56*a* is arranged in the hub 37*a* and is fixedly attached to the end face of the cam shaft 34 by the bolts 53 along with the hub 37*a* as described above. The large diameter cylindrical portion 56*b* is arranged proximately to an outer side face of the driven sprocket 37. In this way, the magnet holder 56 is arranged to cross a rotational center face P of the timing chain 38. A driving magnet 58A in a ring-like shape is fixed to an inner peripheral face of the large diameter cylindrical portion 56*b* by press-fitting or adhesion and an inner peripheral face and an outer end face of the driving magnet 58A is covered with a protection cover 59 made of synthetic resin.

The inner side housing half 41*a* is arranged proximately to the inner peripheral face of the driving magnet 58A to cross the rotational center face P of the timing chain 38. The inner side housing half 41*a* is made of synthetic resin and formed in a shape of a bottomed cylinder and the boss 45 formed at its bottom portion and projected from the outer side face, is arranged to face a space 57 surrounded by the plurality of pieces of bolts 53. Further, there is contained a driven magnet 58B fixedly attached to the pump shaft 47 at inside of the inner side housing half 41*a*. At this occasion, the driven magnet 58B is concentrically arranged with the driving magnet 58A by interposing the inner side housing half 41*a*. Two end faces and an outer peripheral face of the driven magnet 58B, are mold-coupled with a cover member 61 made of synthetic resin and the pump impeller 48 is integrally connected to one end of the cover member 61.

Figure 4:
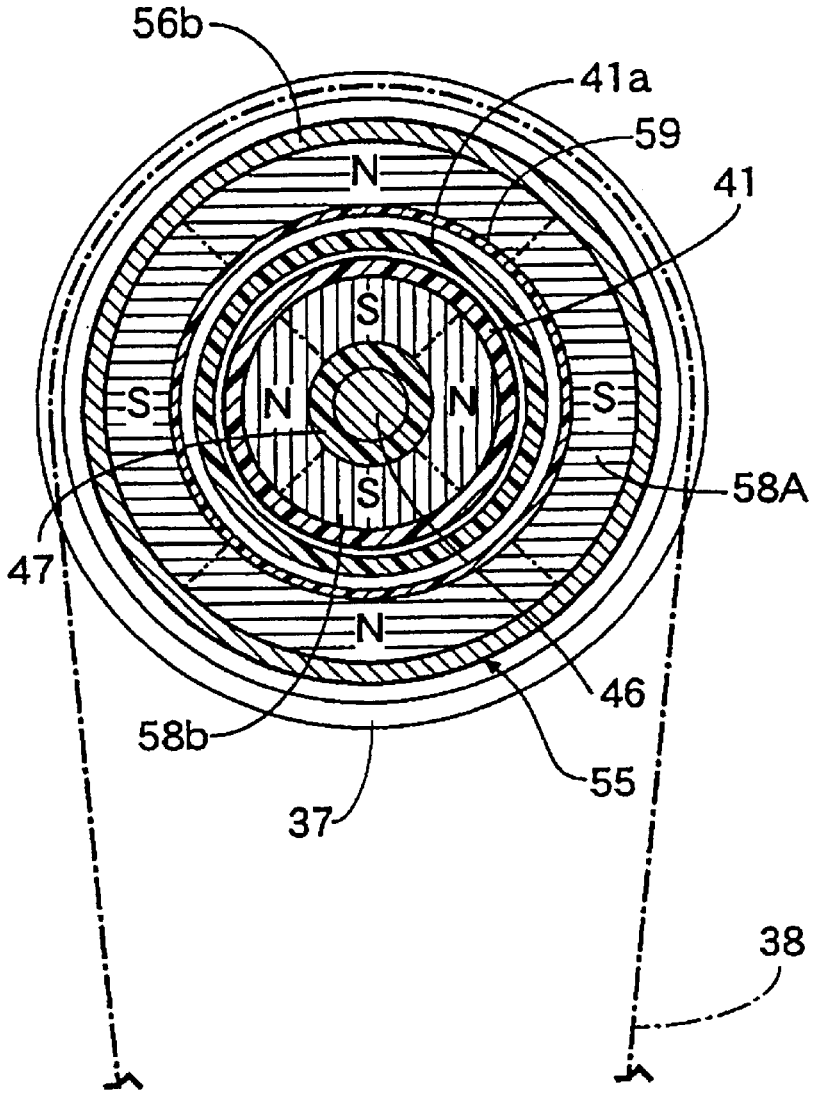
FIG. 4 is a sectional view taken along a line 4—4 of FIG. 3.

As shown by FIG. 4, the driving and the driven magnets 58A and 58B are respectively magnetized alternately with N poles and S poles along peripheral directions and can transmit torque mutually by mutual action of magnetic force.

Next, an explanation will be given of the operation of the embodiment.

In operating the engine 20, the crank shaft 29 drives to rotate the cam shaft 34 via the driving sprocket 36, the timing chain 38 and the driven sprocket 37 to thereby open and close the intake and the exhaust valves 30*i* and 30*e*. Simultaneously therewith, the driving magnet 58A that is integrally connected to the driven sprocket 37 via the magnet holder 56 is also rotated and accordingly, the driven magnet 58B is rotated in a direction the same as that of the driving magnet 58A by the magnetic force effected mutually by the driving magnet 58A and the driven magnet 58B to thereby drive to rotate the pump impeller 48.

Meanwhile, the magnet holder 56 is fixedly attached to the hub 37*a* of the driven sprocket 37 and is provided with the large diameter cylindrical portion 56*b* arranged on the outer side of the driven sprocket 37 and having the diameter larger than the inner diameter of the hub 37*a*. The driving magnet 58A is fixed to the inner peripheral face and accordingly, not only the driving magnet 58A but also the driven magnet 58B surrounded thereby can be formed with sufficiently large diameters without being interfered with by the driven sprocket 37. Thus, an increase in transmission torque of driving magnet 58A and the driven magnet 58B can be achieved.

Further, the magnet holder 56 for holding the driving magnet 58A and the pump housing 41, particularly, the inner side housing half 41*a* for supporting the driven magnet 58B, are arranged such that they cross the rotational center face P of the timing chain 38. Accordingly, the inner side space of the cylindrical hub 37*a* of the driven sprocket 37, constitutes a space for containing portions of the magnet holder 56 and the inner side housing half 41*a* and a total of the driving apparatus 55 can be restrained from enlarging in the axial direction.

Further, the hub 37*a* of the driven sprocket 37 and the magnet holder 56 are fixedly attached to the end face of the cam shaft 34 by the plurality of bolts 53 arranged at the surrounding of the axis line of the cam shaft 34. The boss 45 projects from the outer side face of the inner side housing half 41*a* for supporting the pump shaft 47 and faces the space 57 surrounded by the head portions of the bolts 53. Accordingly, the inner side housing half 41*a* can be arranged to be as proximate as possible to the cam shaft 34 while avoiding mutual interference between the bolts 53 and the boss 45. Therefore, space efficiency of the driven sprocket 37 at an inside of the hub 37*a* is promoted and compactness of the pump driving apparatus 55 can be achieved.

The invention is not limited to the above-described embodiment but the design can be changed without deviating from a range of the present invention. For example, the invention is applicable to driving water pumps of various vehicles other than a motorcycle and to driving fuel pumps of various vehicles including a motorcycle.

As describe above, according to the present invention, in a magnetic force type pump driving apparatus in a vehicular engine in which a driving magnet in a ring-like shape is fixedly attached to a driven rotating member fixedly attached to one end of a driven shaft of a wrapping transmission apparatus for connecting a crank shaft and the driven shaft, a driven magnet is arranged to an inner peripheral side of the driving magnet concentrically to be able to transmit a torque mutually and is axially supported rotatably by a pump housing arranged between the two magnets. A pump rotating member is connected to the driven magnet wherein a magnet holder crossing a rotational center face of a wrapping member of the wrapping transmission apparatus is fixedly attached to the driven rotating member. The driving magnet is arranged at an outer side of the driven rotating member and is attached to the magnet holder and the driven magnet is axially supported by the pump housing arranged to cross the rotational center face on an inner peripheral side of the driving magne. Therefore, a large diameter formation of the driving and the driven magnets is enabled without being interfered with by the driven rotating member of the wrapping transmission apparatus. Thus, the increase in the transmission torque of the magnets can be achieved. Further, the space on the inner peripheral side of the driven rotating member can be made to constitute the space of containing portions of the magnet holder and the pump housing. Thus, the total width of the pump driving apparatus can be restrained from being enlarged in the axial direction.

Further, according to the present invention, the driven rotating member is fixedly attached to an end face of the driven shaft by a plurality of pieces of bolts arranged around an axis line of the driven shaft and a boss projecting from an outer side face of the pump housing for axially supporting the driven magnet that is made to face a space surrounded by head portions of the bolts. Therefore, the pump housing can be arranged to be as proximate as possible to the driven shaft while avoiding mutual interference between the bolts and the boss. Therefore, the space efficiency on the inner peripheral side of the driven rotating member is promoted, which can contribute to the compact formation of the pump driving apparatus.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A magnetic force type pump driving apparatus in a vehicular engine comprising:

a driving magnet formed in a ring-like shape and fixedly attached to a driven rotating member fixedly attached to one end of a driven shaft of a transmission apparatus for connecting a crank shaft and the driven shaft;

a driven magnet arranged to an inner peripheral side of the driving magnet concentrically to be able to transmit a torque mutually, said driven magnet is axially supported rotatably by a pump housing arranged between the two magnets and a pump rotating member is connected to the driven magnet; and a magnet holder crossing a rotational center face (P) of a member of the transmission apparatus, said magnet holder is fixedly attached to the driven rotating member;

the driving magnet is arranged at an outer side of the driven rotating member and is attached to the magnet holder and the driven magnet is axially supported by the pump housing arranged to cross the rotational center face (P) on an inner peripheral side of the driving magnet, wherein a timing chain is wrapped around a sprocket of the transmission apparatus for connecting the driven shaft to the driving shaft.

2. The magnet force type pump driving apparatus in a vehicular engine according to claim 1, wherein the driven rotating member is fixedly attached to an end face of the driven shaft by a plurality of bolts arranged around an axis line of the driven shaft and a boss projecting from an outer side face of the pump housing for axially supporting the driven magnet is made to face a space surrounded by head portions of the bolts.

3. The magnet force type pump driving apparatus in a vehicular engine according to claim 1, wherein said driving magnet is a cylindrical member that is operatively positioned to surround the driven magnet.

4. The magnet force type pump driving apparatus in a vehicular engine according to claim 1, wherein said pump rotating member operatively connected to said driven member includes a pump impeller for supplying fluid through the engine.

5. The magnet force type pump driving apparatus in a vehicular engine according to claim 1, wherein the magnet holder includes a first enlarged diameter section for mounting the driven magnet and a second reduced diameter section for attachment to said driven rotating member.

6. The magnet force type pump driving apparatus in a vehicular engine according to claim 5, wherein said driven rotating member is secured to a cam shaft for imparting rotation thereto.

7. The magnet force type pump driving apparatus in a vehicular engine according to claim 1, wherein said pump housing includes an inner side housing and an outer side housing each being coupled to one side of a cylinder head of the engine, the inner side housing projecting into a timing controlling chamber formed on an inner side of a cylinder block of the engine.

8. The magnet force type pump driving apparatus in a vehicular engine according to claim 1, and further including a cover member disposed to cover the driven magnet, said cover member being formed of a resin material with a pump impeller integrally connected to one end of the cover member.

9. The magnet force type pump driving apparatus in a vehicular engine according to claim 1, wherein the magnet holder crosses the rotational center face (P) of the sprocket of the transmission apparatus.

10. A magnetic force type pump driving apparatus comprising:

a driving magnet adapted to be operatively attached to a driven rotating member secured to one end of a driven shaft, the driven rotating member being a sprocket of a timing control transmission apparatus;

a driven magnet concentrically arranged to be disposed to an inner peripheral side of the driving magnet for transmitting a torque, said driven magnet being axially supported rotatably by a pump housing arranged between the driving magnet and the driven magnet;

a pump rotating member operatively connected to the driven magnet; and a magnet holder crossing a rotational center face (P) of the driven rotating member;

the driving magnet is disposed to surround the driven rotating member and the driving magnet is attached to the magnet holder, said driven magnet being axially supported by the pump housing arranged to cross the rotational center face (P) on an inner peripheral side of the driving magnet.

11. The magnet force type pump driving apparatus according to claim 10, wherein the driven rotating member is fixedly attached to an end face of the driven shaft by a plurality of pieces of bolts arranged around an axis line of the driven shaft and a boss projecting from an outer side face of the pump housing for axially supporting the driven magnet is made to face a space surrounded by head portions of the bolts.

12. The magnet force type pump driving apparatus according to claim 10, wherein said driving magnet is a cylindrical member that is operatively positioned to surround the driven magnet.

13. The magnet force type pump driving apparatus according to claim 10, wherein said pump rotating member operatively connected to said driven member includes a pump impeller for supplying fluid through an engine.

14. The magnet force type pump driving apparatus according to claim 13, wherein said driven rotating member is secured to a cam shaft for imparting rotation thereto.

15. The magnet force type pump driving apparatus according to claim 10, wherein the magnet holder includes a first enlarged diameter section for mounting the driven magnet and a second reduced diameter section for attachment to said driven rotating member.

16. The magnet force type pump driving apparatus according to claim 10, wherein said pump housing includes an inner side housing and an outer side housing each being coupled to one side of a cylinder head of an engine, the inner side housing projecting into a timing controlling chamber formed on an inner side of a cylinder block of the engine.

17. The magnet force type pump driving apparatus according to claim 10, and further including a cover member disposed to cover the driven magnet, said cover member being formed of a resin material with a pump impeller integrally connected to one end of the cover member.

* * * * *